United States Patent [19]

Raasch

[11] Patent Number: 4,662,170

[45] Date of Patent: May 5, 1987

[54] SPINNING ROTOR WITH A COATING FOR IMPROVING THE SPINNING RESULT

[75] Inventor: Hans Raasch, Mönchengladbach, Fed. Rep. of Germany

[73] Assignee: W. Schlafhorst & Co., Möenchengladbach, Fed. Rep. of Germany

[21] Appl. No.: 668,258

[22] Filed: Nov. 5, 1984

[30] Foreign Application Priority Data

Nov. 4, 1983 [DE] Fed. Rep. of Germany ..... 3339852

[51] Int. Cl.[4] ..... B32B 19/04; D01H 7/882

[52] U.S. Cl. ..... 57/416; 428/698

[58] Field of Search ..... 57/302, 414, 416, 404, 57/413, 417; 428/698, 699, 704, 469, 472

[56] References Cited

U.S. PATENT DOCUMENTS

| | | | |
|---|---|---|---|
| 3,439,487 | 4/1969 | Landwehrkamp et al. | 57/414 |
| 3,964,937 | 6/1976 | Post et al. | 428/698 X |
| 4,167,846 | 9/1979 | Shaw et al. | 57/414 |
| 4,193,253 | 3/1980 | Herbert et al. | 57/414 |
| 4,237,184 | 12/1980 | Gonseth et al. | 428/698 X |
| 4,358,923 | 11/1982 | Feldstein | 57/414 X |
| 4,385,488 | 5/1983 | Raasch et al. | 57/416 X |
| 4,397,144 | 8/1983 | Raasch et al. | 57/414 |
| 4,404,015 | 9/1983 | Nakai et al. | 428/698 X |
| 4,406,668 | 9/1983 | Sarin et al. | 428/698 X |
| 4,502,273 | 3/1985 | Miyamoto et al. | 57/414 |

*Primary Examiner*—John M. Jillions
*Assistant Examiner*—Joseph J. Hail, III
*Attorney, Agent, or Firm*—Herbert L. Lerner; Laurence A. Greenberg

[57] ABSTRACT

A spinning rotor of an open-end spinning machine, includes a steel body having a sliding surface formed thereon and a collection groove formed therein for spinning fibers, a surface layer disposed at least on the interior of the body formed of at least one material from the group consisting of iron carbide, iron boride, iron silicide and iron nitride, the interior surface layer including a portion coming in contact with the spinning fibers, and an additional coating disposed on the portion being formed of non-ferrous metal having granules of a hard substance embedded therein.

7 Claims, 3 Drawing Figures

SPINNING ROTOR WITH A COATING FOR IMPROVING THE SPINNING RESULT

The invention relates to a spinning rotor for an open-end spinning machine, including a fiber sliding surface, a fiber collection groove, and a surface layer formed at least on the interior thereof, formed of iron carbide, iron boride, iron silicide or iron nitride, or a combination thereof.

In open-end spinning frames or machines, the spinning rotor is exposed to considerable wear at the locations where it comes into contact with the fibers, especially in the fiber collection groove. This has detrimental results, because the shape and surface structure of the spinning rotor influences the structure of the spun thread to a great extent, and controls the stability of the spinning operation. If the surface structure changes due to wear, the structure of the spun thread also changes, and the stability of the spinning process is disturbed.

The wear of the spinning rotor is considerably reduced if at least the interior of the spinning rotor has a surface layer which is formed of either iron carbide, iron boride, iron silicide, or iron nitride, or a combination thereof.

It is accordingly an object of the invention to provide a spinning rotor which overcomes there hereinaforementioned disadvantages of the heretofore-known devices of this general type, and which further reduces the wear of the rotor.

With the foregoing and other objects in view there is provided, in accordance with the invention, a spinning rotor of an open-end spinning machine, comprising a steel body having a sliding surface formed thereon and a collection groove formed therein for spinning fibers, a surface layer disposed at least on the interior of the body formed of at least one material from the group consisting of iron carbide, iron boride, iron silicide and iron nitride, the interior surface layer including a portion coming in contact with the spinning fibers, and an additional coating disposed on the portion being formed of non-ferrous metal having granules of a hard substance embedded therein.

For this purpose, particles of materials which are used for grinding steel, or which form the active material for grinding wheels (silicon carbide, aluminum oxide or the like), are given special consideration. Hard and/or brittle crystals or crystallites up to the hardness of diamonds are especially suited as the hard material granules.

A rotor produced according to the invention produces especially good results in actual operation. A uniform thread with greater strength and less flaws is produced over a long period. This surprising effect is explained by the joint effect of the above-mentioned surface layer and the measures described according to the invention.

In accordance with another feature of the invention, the non-ferrous metal of the coating is nickel. In the fiber collection groove, the coating must be strong enough to retain the hard particles. The good spinning result is maintained during the spinning operation, even though the coating wears during operation and the hard grains eventually break out. This behavior of the spinning rotor according to the invention, which is contradictory by itself, can be explained by the fact that while the nickel layer slowly wears, the parts of the surface layer formed of iron carbide, iron boride, iron silicide or iron nitride come to the surface, and actually come into active contact with the fiber material.

In accordance with a further feature of the invention, the hard substance of the coating is diamond. This type of rotor yields especially good spinning results.

In accordance with an added feature of the invention, the total coating is formed of substantially 10 to 30% by volume of the hard substance.

In accordance with an additional feature of the invention, the size of the granules is substantially between 1 and 6 micrometers.

Grains in this range yield particularly good results.

The most simple structure is produced if the whole interior surface of the spinning rotor is coated with a non-ferrous metal with the hard grains embedded therein. Therefore, the fiber collection groove and especially the bottom thereof also has the hard coating. If the fiber material which is processed contains fine dust or forms fine dust, this dust is therefore collected at the bottom of the groove, and after a certain amount of time, the spinning result worsens. Hard particles at the bottom of the groove increase the collection of dust in the groove.

In accordance with a concomitant feature of the invention, the body includes a transition region between the sliding surface and the fiber collection groove, the additional coating being disposed on the transition region and the sliding surface, and the groove or at least the bottom of the fiber collection groove are free of the granules. This is done in order to avoid the collection of dust in the groove. For example, this can be achieved by inserting an insulating ring into the fiber collection groove during the chemical or galvanic formation of the coating according to the invention. In this case, the fiber collecting groove or its bottom may still receive a metal coating, but at least the larger particles of hard material cannot reach the parts masked by the ring, which is made of an insulating or plastic material.

Other features which are considered as characteristic for the invention are set forth in the appended claims.

Although the invention is illustrated and described herein as embodied in a spinning rotor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
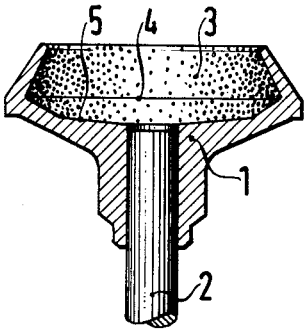
FIG. 1 is a fragmentary, diagrammatic, cross-sectional view of a spinning rotor according to the invention.

Referring now to the figures of the drawings in detail and first particularly to FIG. 1 thereof, there is seen a spinning rotor having a body 1 which is made of steel and is pressed onto a shaft 2. The rotor body has a conically-shaped interior slide or sliding surface 3 for the fibers, which ends at a fiber collection groove 4. The remaining part 5 of the interior surface extends from the fiber collection groove 4 to the end of the shaft 2.

Before the spinning rotor 1 is pressed onto the shaft 2, it undergoes a pre-treatment. First the rotor is prepared on a lathe. Then the hole into which the shaft 2 is to be later inserted, is temporarily closed with a heat resistant material. Finally, the entire interior space is filled with a powder containing boron. The spinning rotor 1 is then heated to 920° C. with its opening facing upward in a protective gas atmosphere in a retort. After cooling, the excessive, unused boron-containing powder is removed from the interior space enclosed by the surface 3. Subsequently, the spinning rotor 1 is again heated in a protective gas in a retort to 830° C., and is then immediately quenched in oil. The rotor 1 is then brought to a temparature of 400° C. and is again quenched in oil.

The result of this pre-treatment is an improved interior surface layer in the inner space formed of iron boride. Iron carbide, iron silicide or iron nitride layers may also be used alone or in any combination of the four materials.

After cleaning the surface of the rotor, except for the inner space which is masked, the rotor is placed in a solution containing nickel in which diamond grains or granules are kept in suspension by a turbulent current in the suspension. In this way, the desired nickel coating with embedded diamond granules is formed on the interior surface of the spinning rotor, by chemical means.

Figure 2:
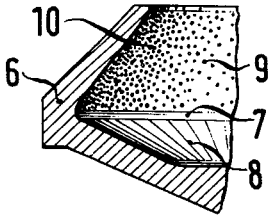
FIG. 2 is a fragmentary, cross-sectional view of another embodiment of the invention.

The spinning rotor 6 according to FIG. 2 has undergone the same pre-treatment as the rotor shown in FIG. 1. However, during the formation of the coating, the fiber collection groove 7 and the portion 8 below the fiber collection groove 7 are masked. A nickel coating is thus produced in which diamond granules 10 are only embedded on the fiber slide or sliding surface 9.

Figure 3:
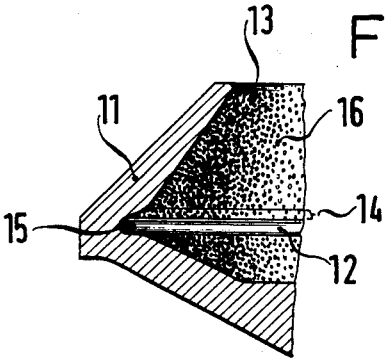
FIG. 3 is a fragmentary, cross-sectional view of a third embodiment of the spinning rotor of the invention.

The spinning rotor 11 according to FIG. 3 has a somewhat differently-shaped fiber collection groove 12. The groove 12 is more pronounced than in the other two rotors. The transition region 14 between the fiber slide or sliding surface 13 and the fiber collection groove 12 is more pronounced and clearly shown. During the production of the coating, an insulating ring is inserted into the fiber collection groove 12, so that the bottom 15 of the groove 12 contains no diamond granules 16.

I claim:

1. Spinning rotor of an open-end spinning machine, comprising a steel body having a sliding surface formed thereon and a collection groove formed therein for spinning fibers, a surface layer disposed at least on the interior of said body formed of a compound of iron and a non-metal, and an additional coating disposed on said interior surface layer at least at said sliding surface being formed of non-ferrous metal having granules of a hard substance embedded therein, at least the bottom of said fiber collection groove being free of said granules.

2. Spinning rotor according to claim 1, wherein said non-ferrous metal of said coating is nickel.

3. Spinning rotor according to claim 1, wherein said hard substance of said coating is diamond.

4. Spinning rotor according to claim 2, wherein said hard substance of said coating is diamond.

5. Spinning rotor according to claim 1, wherein said coating is formed of substantially 10 to 30% by volume of said hard substance.

6. Spinning rotor according to claim 1, wherein the size of said granules is substantially between 1 and 6 micrometers.

7. Spinning rotor according to claim 1, wherein said body includes a transition region between said sliding surface and said fiber collection groove, said additional coating being disposed on said transition region and said sliding surface.

* * * * *